US007756434B2

(12) United States Patent
Murata

(10) Patent No.: US 7,756,434 B2
(45) Date of Patent: Jul. 13, 2010

(54) IMAGE FORMING APPARATUS WITH ELECTRIC POWER SAVING MODE

(75) Inventor: Takurou Murata, Osaka (JP)

(73) Assignee: Kyocera Mita Corporation (JP)

( * ) Notice: Subject to any disclaimer, the term of this patent is extended or adjusted under 35 U.S.C. 154(b) by 334 days.

(21) Appl. No.: 11/899,233

(22) Filed: Sep. 5, 2007

(65) Prior Publication Data

US 2008/0056751 A1 Mar. 6, 2008

(30) Foreign Application Priority Data

Sep. 6, 2006 (JP) ..... 2006-241896

(51) Int. Cl.
*G03G 15/20* (2006.01)

(52) U.S. Cl. ..... 399/70

(58) Field of Classification Search ..... 399/67, 399/69, 70

See application file for complete search history.

(56) References Cited

U.S. PATENT DOCUMENTS 6,166,355 A * 12/2000 Watanabe et al. ..... 219/497

FOREIGN PATENT DOCUMENTS

| | | |
|---|---|---|
| CN | 1217488 | 5/1999 |
| JP | 59-201078 | 11/1984 |
| JP | 2004-230605 | 8/2004 |

* cited by examiner

*Primary Examiner*—Hoang Ngo
(74) *Attorney, Agent, or Firm*—Gerald E. Hespos; Michael J. Porco

(57) ABSTRACT

An image forming apparatus includes a power switch for turning on and off a power source. An electric power saving mode designation acceptor can accept a designation to set a power saving mode to suppress power consumption. The apparatus further has an image former for forming a toner image on a sheet; a fixing device for thermally fixing the toner image; a heater for heating the fixing device; and an electric power saving controller for shifting to the power saving mode if the power saving mode designation is accepted by the power saving mode designation acceptor, and for controlling the heating section to heat the fixing device to a predetermined fixing temperature necessary for fixing the toner image on the sheet if the power saving mode designation is not accepted by the electric power saving mode designation acceptor, in response to shifting of the power switch from off to on.

8 Claims, 4 Drawing Sheets

IMAGE FORMING APPARATUS WITH ELECTRIC POWER SAVING MODE

BACKGROUND OF THE INVENTION

1. Field of the Invention

The present invention relates to an image forming apparatus provided with an electric power saving mode for suppressing an electric power consumption.

2. Description of the Related Art

There is known an electrophotographic image forming apparatus equipped with an electric power saving mode for suppressing an electric power consumption by keeping a fixing device for thermally fixing a toner image on a recording sheet (hereinafter, simply called as "a sheet" or "sheets) in a standby state by lowering the temperature of the fixing device to a predetermined temperature, if an image formation is not performed for a predetermined period. An example of the image forming apparatus equipped with the electric power saving mode is e.g. disclosed in Japanese Unexamined Patent Publication No. 2004-230605.

Specifically, the apparatus disclosed in the publication is constructed in such a manner that a storage stores therein the number of times when the apparatus performs a printing operation without shifting to the electric power saving mode after the power source of the apparatus is turned on, and the number of times when the apparatus shifts to the electric power saving mode without performing a printing operation after the power source of the apparatus is turned on. If the number of times when the apparatus performs a printing operation without shifting to the electric power saving mode after the power source of the apparatus is turned on is larger, a warm-up operation is performed, in other words, the temperature of the fixing device is swiftly increased to a predetermined fixing temperature necessary for fixing a toner image on a sheet immediately after the power source of the apparatus is turned on. If, on the other hand, the number of times when the apparatus shifts to the electric power saving mode without performing a printing operation after the power source of the apparatus is turned on is larger, the apparatus is swiftly shifted to the electric power saving mode immediately after the power source of the apparatus is turned on to thereby suppress an electric power consumption.

There is also known an arrangement, in which it is determined whether the apparatus is to be shifted to the electric power saving mode next time, or a warm-up operation is to be performed, when the power source is turned on before the power source of the apparatus is turned off.

The following drawback is involved in the arrangement in which it is determined whether the apparatus is to be shifted to the electric power saving mode, or a warm-up operation is to be performed next when the power source is turned on depending on a proceeding status of the apparatus to the electric power saving mode after the power source of the apparatus is turned on; or the arrangement in which it is determined whether the apparatus is to be shifted to the electric power saving mode, or a warm-up operation is to be performed next time when the power source is turned on before the power source of the apparatus is turned off. In some cases, the apparatus may be shifted to the electric power saving mode against a user's intension to start printing immediately after the power source of the apparatus is turned on, or it may take an unduly long time until the apparatus is brought to a printing ready state. In other cases, a warm-up operation may be started against a user's intension to save an electric power consumption after the power source of the apparatus is turned on, which may resultantly increase an electric power consumption.

SUMMARY OF THE INVENTION

In view of the above problems residing in the prior art, it is an object of the invention to provide an image forming apparatus that is securely settable to an electric power saving mode or to a condition where a warm-up operation is ready to be started immediately after a power source of the apparatus is turned on, depending on a user's intension.

An image forming apparatus according to an aspect of the invention includes: a power source switch for turning on and off a power source of a main body of the apparatus; an electric power saving mode designation acceptor for accepting a designation to set the apparatus main body to an electric power saving mode in response to an external operation to suppress an electric power consumption of the apparatus main body; an image former for forming a toner image on a sheet; a fixing device for thermally fixing the toner image formed on the sheet by the image former onto the sheet; a heating section for heating the fixing device; and an electric power saving controller for shifting the apparatus main body to the electric power saving mode if the electric power saving mode designation is accepted by the electric power saving mode designation acceptor, and for controlling the heating section to heat the fixing device to a predetermined fixing temperature necessary for fixing the toner image onto the sheet if the electric power saving mode designation is not accepted by the electric power saving mode designation acceptor, in response to shifting of the power source switch from an off-state to an on-state.

In the above arrangement, if the electric power saving mode designation is accepted in response to the user's manipulation of the electric power saving mode designation acceptor, when the power source switch is shifted from the off-state to the on-state, the apparatus main body is shifted to the electric power saving mode. Thereby, the electric power consumption of the apparatus main body is suppressed. On the other hand, if the user does not manipulate the electric power saving mode designation acceptor, and accordingly, the electric power saving mode designation is not accepted, when the power source switch is shifted from the off-state to the on-state, the heating section heats the fixing device to the predetermined fixing temperature necessary for fixing the toner image onto the sheet. Thereby, the apparatus main body is brought to a printing ready state. This enables to securely set whether the electric power saving mode is to be designated, or a warm-up operation is to be started immediately after the power source of the apparatus main body is turned on depending on the user's intension.

These and other objects, features and advantages of the present invention will become more apparent upon reading the following detailed description along with the accompanying drawing.

DETAILED DESCRIPTION OF THE PREFERRED EMBODIMENTS

Figure 1:
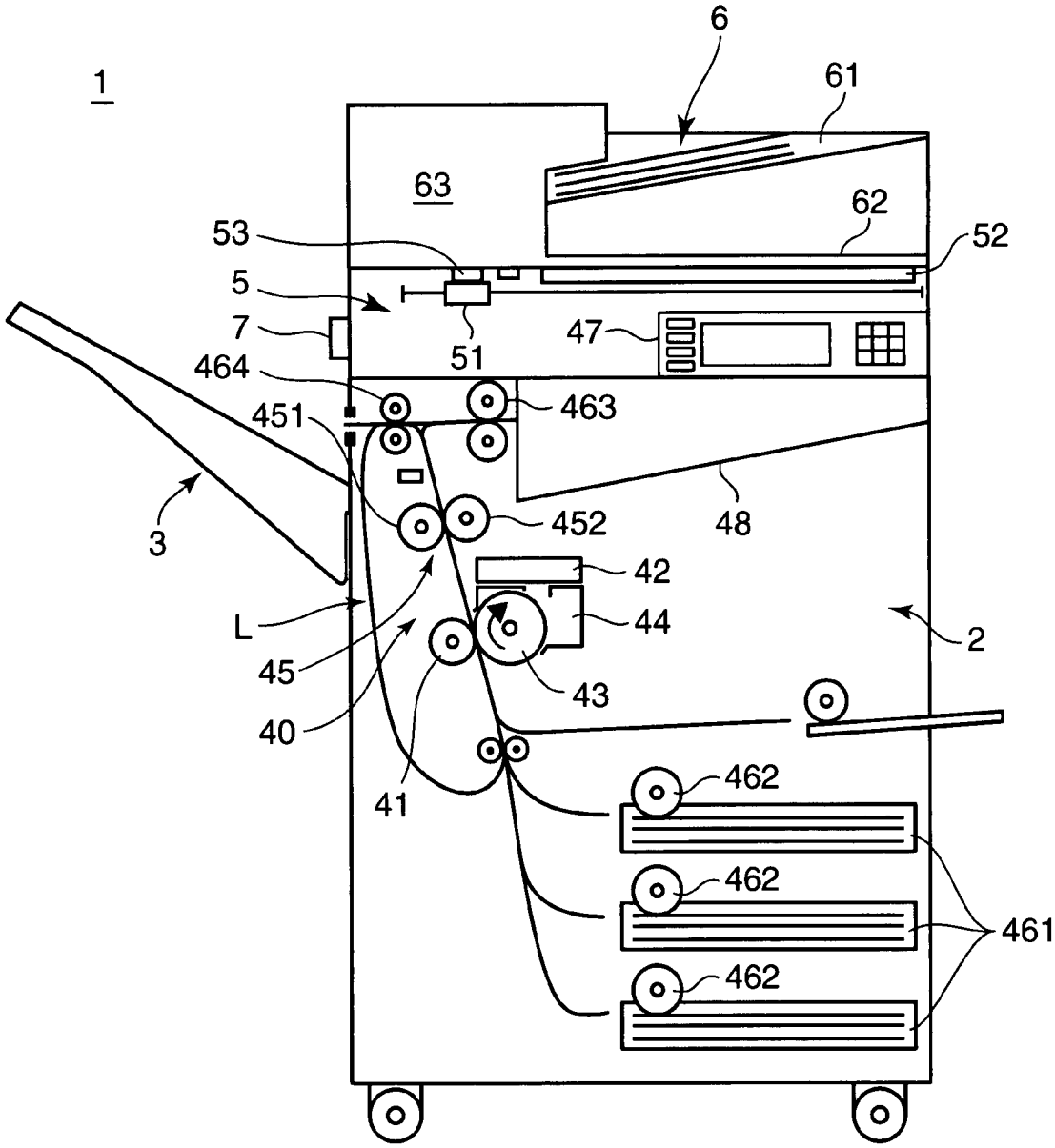
FIG. 1 is a side view schematically showing an internal arrangement of a complex machine, as an example of an image forming apparatus embodying the invention.
Figure 2:
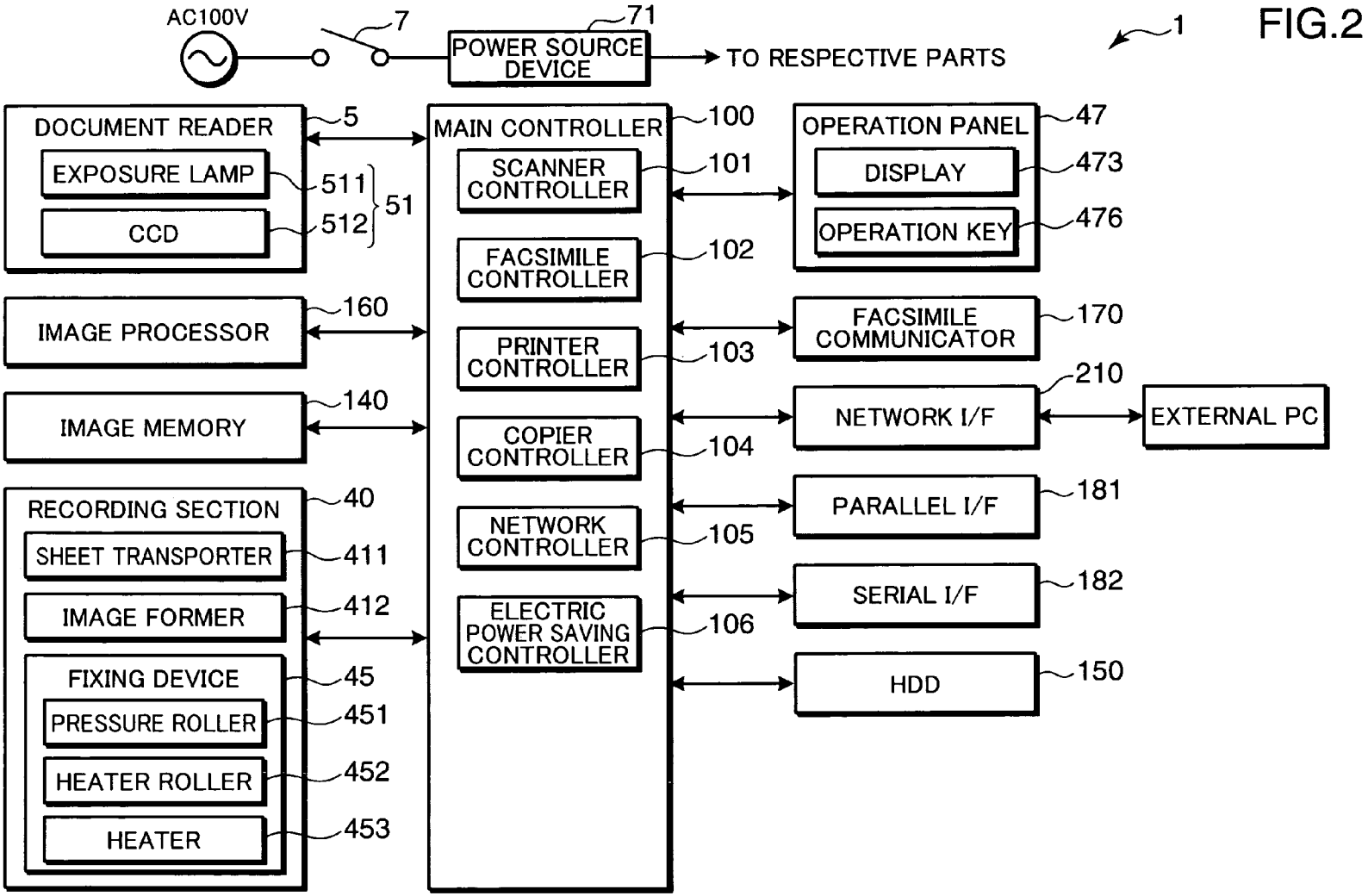
FIG. 2 is a block diagram showing an electric configuration of the complex machine shown in FIG. 1.

In the following, an embodiment of the invention is described referring to the drawings. Elements with identical reference numerals throughout the drawings have identical constructions, and accordingly, repeated description thereof will be omitted herein. FIG. 1 is a side view schematically showing an internal arrangement of a complex machine, as an example of an image forming apparatus embodying the invention. FIG. 2 is a block diagram showing an electric configuration of the complex machine shown in FIG. 1.

The complex machine 1 has various functions such as a function of a copier, a function of a printer, a function of a scanner, and a function of a facsimile machine. The complex machine 1 includes a main body 2, a stacker tray 3 disposed on a left side of the machine main body 2, a document reader 5 disposed on an upper part of the machine main body 2, a document feeder 6 disposed above the document reader 5, and a main controller 100 (see FIG. 2) provided inside the machine main body 2. The complex machine 1 further includes a substantially rectangular operation panel 47 at a front part of the machine main body 2, and a power source switch 7 at an upper position on a left wall of the machine main body 2 in FIG. 1.

Figure 3:
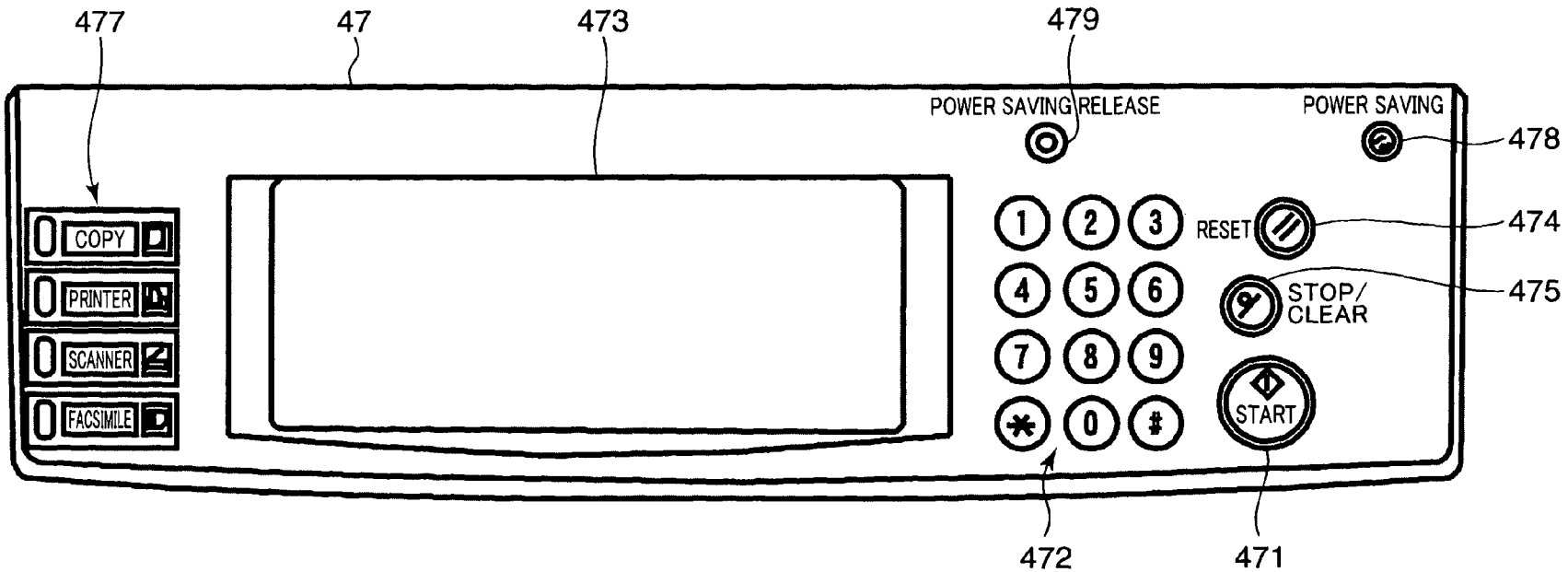
FIG. 3 is a diagram showing an external appearance of an operation panel shown in FIG. 1.

FIG. 3 is a diagram showing an external appearance of the operation panel 47. The operation panel 47 includes a start key 471 for allowing a user to input a print execution command; a ten key 472 for allowing the user to input the number of prints or the like; a display section 473 which is adapted to display operation guide information or the like concerning various operations of the complex machine 1, and which is provided with a liquid crystal display or a like device having a touch-panel function for allowing the user to input various setting commands; a reset key 474 for resetting the setting contents set on the display section 473; a stop key 475 for suspending an ongoing printing operation i.e. image forming operation; and a function changeover key 477 for changing over the function of the complex machine 1 among the copying function, the printing function, the scanning function, and the facsimile function.

An electric power saving key 478, as an electric power saving mode designation acceptor, is provided at a position near an upper right corner of the operation panel 47. In response to depressing the electric power saving key 478, the electric power saving key 478 is operated to accept a designation to set the complex machine 1 to an electric power saving mode for suppressing an electric power consumption of the complex machine 1. An electric power saving release key 479, as an electric power saving release acceptor, is provided at a position leftwardly away from the substantially circular-shaped electric power saving key 478 at e.g. a position distanced from the electric power saving key 478 by about seven times as large as the diameter of the electric power saving key 478 to accept a designation to release the electric power saving mode. The electric power saving key 478 and the electric power saving release key 479 may be disposed away from each other by a distance corresponding to at least the width of a human's finger or more, e.g., by 2 cm or more to avoid a user's erroneous manipulation. The start key 471, the ten key 472, the reset key 474, the stop key 475, the function changeover key 477, the electric power saving key 478, and the electric power saving release key 479 are generically called as an operation key section 476.

In the embodiment, the electric power saving release key 479 is provided independently of the electric power saving key 478. Alternatively, the electric power saving key 478 may also be functioned as the electric power saving release acceptor by constructing the electric power saving key 478 in such a manner that a designation to release the electric power saving mode is accepted when the electric power saving key 478 is depressed while the complex machine 1 is in the electric power saving mode.

The document reader 5 has a scanner unit 51 equipped with a CCD (Charge Coupled Device) sensor 512 and an exposure lamp 511, a document table 52 made of a transparent member such as a glass member, and a document reading slit 53. The scanner unit 51 is movable by an unillustrated driver. Specifically, in reading a document placed on the document table 52, the scanner unit 51 is moved to such a position as to oppose the document table 52 along a document plane, acquires image data while scanning the document image, and outputs the acquired image data to the main controller 100. In reading a document fed by the document feeder 6, the scanner unit 51 is moved to such a position as to oppose the document reading slit 53, acquires the document image in synchronism with a transport operation of the document by the document feeder 6 through the document reading slit 53, and outputs the acquired image data to the main controller 100.

The document feeder 6 includes a document setter 61 for placing a document or documents, a document discharger 62 for discharging the document(s) after the image reading, and a document transport mechanism 63. The document transport mechanism 63 has a feed roller (not shown) and a transport roller (not shown) for successively transporting the documents placed on the document setter 61 to a position as opposed to the document reading slit 53 so as to discharge the documents to the document discharger 62. The document transport mechanism 63 also has a document inverting mechanism (not shown) for inverting the document to transport the document to the position as opposed to the document reading slit 53 again, whereby both-side images of the document are read by the scanner unit 51 through the document reading slit 53.

The document feeder 6 is pivotally mounted to the machine main body 2 in such a manner that a front part of the document feeder 6 is pivotally moved upward. By pivotally moving the front part of the document feeder 6 upward to open an upper surface of the document table 52, the user is allowed to place a document e.g. a book in an opened state on the upper surface of the document table 52.

The machine main body 2 includes a number of sheet cassettes 461, a sheet feed roller 462 for dispensing sheets accommodated in the corresponding sheet cassette 461 one by one to transport the sheet to a recording section 40, the recording section 40 for forming an image on the sheet transported from the sheet cassette 461, and the main controller 100 for controlling overall operations of the complex machine 1.

The recording section 40 includes an image former 412, a fixing device 45, and a sheet transporter 411. The image former 412 has an optical unit 42, a photosensitive drum 43, a developer 44, and a transferer 41. The optical unit 42 outputs a laser beam or the like based on the image data acquired in the scanner unit 51 to expose a photosensitive drum 43 with the laser beam. The developer 44 forms a toner image on the surface of the photosensitive drum 43. The transferer 41 transfers the toner image formed on the photosensitive drum 43 to the sheet.

The fixing device 45 fixes the toner image onto the sheet by applying a heat to the sheet carrying the toner image. The sheet transporter 411 has transport roller pairs 463 and 464 which are provided at respective appropriate positions on a sheet transport path in the recording section 40 to transport the sheet to the stacker tray 3 or a discharge tray 48.

The fixing device 45 has a pressure roller 451 with an elastic member made of a silicon rubber or the like being formed on a surface thereof, and a heater roller 452. A heater 453 as a heating section is built in the heater roller 452. The heater 453 is constituted of e.g. a halogen lamp, a ceramic heater, or a like device. An electric current flowing through the heater 453 is regulated based on a control signal from the controller 10, in other words, the heater 453 is controllably energized and de-energized.

In the case where an image is formed on both sides of a sheet, after an image is formed on one side of the sheet in the recording section 40, the sheet is nipped by the transport roller pair 463 near the discharge tray 48. Then, the sheet in the nipped state is switchbacked by reversing the rotating direction of the transport roller pair 463 to transport the sheet to a sheet transport path L. After the sheet is transported to the sheet transport path L, the sheet is transported upstream of the recording section 40 again for image formation on the other side of the sheet in the recording section 40. Thereafter, the sheet is discharged onto the stacker tray 3 or the discharge tray 48.

Referring to FIG. 2, the complex machine 1 includes a power source device 71 for converting a commercial alternate current (AC) power source voltage e.g. AC 100V to a direct current (DC) voltage of a predetermined value to supply the DC voltage to the relevant parts in the complex machine 1. The commercial AC power source voltage is supplied to the power source device 71 via the power source switch 7. When the power source switch 7 is turned off, the complex machine 1 suspends its operation, and when the power source switch 7 is turned on, the complex machine 1 is started up.

In the embodiment, the power source switch 7 turns on and off the primary end of the power source device 71 i.e. the commercial AC power source voltage. Alternatively, the power source switch 7 may turn on and off the secondary end of the power source device 71 i.e. a voltage to be supplied from the power source device 71 to the relevant parts in the complex machine 1. Further alternatively, the power source switch 7 may be e.g. an operation switch for outputting a control signal designating supply/non-supply of a power source voltage to the main controller 100 in response to a user's manipulation.

The main controller 100 is connected to an image memory 140 for temporarily storing document data or the like read by the scanner unit 51, and to an HDD 150, as a large-capacity storage device with a storage capacity capable of storing a large amount of document data. The HDD 150 is designed to store data representing a document image read by the document reader 5 based on a control signal from the main controller 100 when a user's designation to execute an image formation is accepted through the operation panel 47.

In reading a document by the scanner unit 51, an image processor 160 converts an analog image signal outputted from the scanner unit 51 to a digital image. After an image processing is applied to improve image quality, the image processor 160 converts the digital image into a compressed image. The compressed image is written into the image memory 140. The main controller 100 is operative to store the compressed image written in the image memory 140 into the HDD 150 as data constituting a file, which is an object for document administration. In printing an image, the data read out by the document reader 5, or the data i.e. the compressed image read out from the HDD 150 is written into the image memory 140. In response to writing the data into the image memory 140, the image processor 160 decompresses the compressed data. The decompressed data is subjected to an image processing depending on an output status i.e. laser exposure, LED exposure, or the like. For instance, in case of laser exposure, the image processor 160 analog-modulates a laser signal, which is used in controlling a laser beam to be emitted from an exposure device. Then, an image is printed on a sheet by the recording section 40 based on the analog-modulated signal.

The main controller 100 controls overall operations of the complex machine 1. For instance, the main controller 100 includes a CPU (Central Processing Unit) for executing a predetermined computation process, an ROM (Read Only Memory) in which a predetermined control program is stored, an RAM (Random Access Memory) for temporarily storing data, and peripheral circuits provided in relation to these components. The main controller 100 functions as a scanner controller 101, a facsimile controller 102, a printer controller 103, a copier controller 104, a network controller 105, and an electric power saving controller 106 for controlling an operation of the complex machine 1 when the complex machine 1 is in the electric power saving mode, by executing the control program stored in the ROM.

The scanner controller 101 controls operations of the relevant parts necessary to operate the complex machine 1 as a scanner. The facsimile controller 102 controls operations of the relevant parts necessary to operate the complex machine 1 as a facsimile machine. The facsimile controller 102 controls a facsimile communicator 170 for handling data necessary for facsimile communication. The facsimile communicator 170 has an NCU (Network Control Unit) for controlling connection of a telephone line with a counterpart facsimile machine for facsimile communication. The copier controller 104 controls operations of the relevant parts necessary to operate the complex machine 1 as a copier.

The printer controller 103 controls operations of the relevant parts necessary to operate the complex machine 1 as a printer. The printer controller 103 is connected to a parallel I/F 181 with which the complex machine 1 is connected to an external device by parallel transmission of simultaneously transmitting data in the unit of several bits, using plural signal lines; and to a serial I/F 182 with which the complex machine 1 is connected to an external device by serial transmission of sequentially transmitting data one bit by one bit, using a single signal line.

The network controller 105 controls data communication between the complex machine 1 and an external PC (personal computer) connected to the complex machine 1 on a network, or between the complex machine 1 and a site on the Internet. The network controller 105 communicates data with the external PC or a like data transmitter/receiver via the network I/F 210.

The electric power saving controller 106 controls the complex machine 1 to shift to the electric power saving mode in response to a user's depressing the electric power saving key 478, i.e. in response to accepting an electric power saving mode designation, when the power source switch 7 is shifted from an off-state to an on-state. When the complex machine 1 is brought to the electric power saving mode, an electric power consumption is suppressed by regulating an electric current flowing through the heater 453 in such a manner that the temperature of the heater roller 452 is lowered to an electric power saving temperature Ts, which is lower than a fixing temperature Tt necessary for fixing a toner image on a sheet. If, on the other hand, the electric power saving key 478 is not depressed when the power source switch 7 is shifted from an off-state to an on-state, in other words, an electric power saving mode designation is not accepted, the electric power saving controller 106 controls the heater 453 to heat the heater roller 452 to the fixing temperature Ts.

Figure 4:
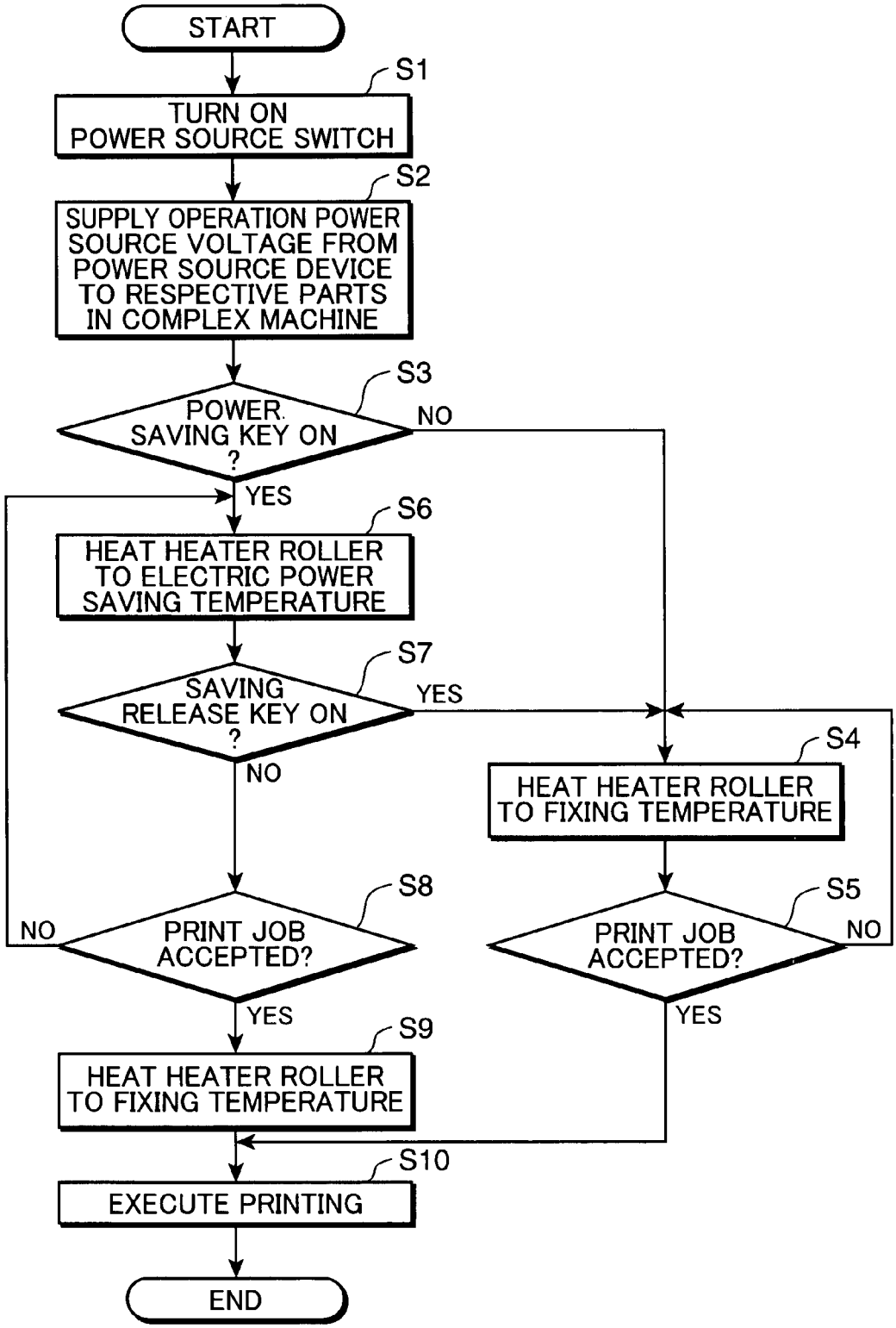
FIG. 4 is a flowchart showing an operation to be executed by the complex machine shown in FIG. 2.

In the following, an operation of the complex machine 1 having the above arrangement is described referring to FIG. 4. FIG. 4 is a flowchart showing an example of the operation of the complex machine shown in FIG. 2. After the complex machine 1 is started up, if a user wishes to promptly start a printing operation without bringing the complex machine 1 to the electric power saving mode, the user turns the power source switch 7 on without depressing the electric power saving key 478 (Step S1). Thereby, the power source device 71 is operative to supply an operation power source voltage from the commercial AC power source voltage to the relevant parts in the complex machine 1 (Step S2). Then, the main controller 100 starts executing the control program stored in the ROM.

In response to start of execution of the control program by the main controller 100, the electric power saving controller 106 is promptly operative to check whether the electric power saving key 478 is in an on-state (Step S3). The time duration from the point of time when the electric power switch 7 is turned on to the point of time when the main controller 100 starts executing the control program is e.g. one second or less, which is a short time, as compared with a time required for a person to manipulate the electric power switch 7 or the electric power saving key 478. Accordingly, if the user turns the electric power switch 7 on without depressing the electric power saving key 478, the electric power saving controller 106 is operative to detect that the electric power saving key 478 is in an off-state in Step S3. Thereby, the routine goes to Step S4 so that the complex machine 1 promptly starts a printing operation.

In Step S4, the heater 453 performs a warm-up operation of heating the heater roller 452 to the predetermined fixing temperature Tt, based on a control signal from the electric power saving controller 106. Then, the complex machine 1 enters into a job waiting state waiting for a print job, in which e.g. the user is allowed to depress the start key 471, or image data transmitted from an external PC via the network is allowed to be received by the network I/F 210 (Step S5). If it is judged that a print job is not accepted (NO in Step S5), the routine goes to Step S4 to continue the warm-up operation. If, on the other hand, a print job is accepted (YES in Step S5), the routine proceeds to Step S10 to perform a printing operation.

As mentioned above, after the complex machine 1 is started up, if the user wishes to promptly start executing a printing operation without bringing the complex machine 1 to the electric power saving mode, the user turns the power source switch 7 on without depressing the electric power saving key 478. Thereby, a warm-up operation is executed without causing the complex machine 1 to shift to the electric power saving mode. Thus, the complex machine 1 is brought to a printing ready state where a printing operation is promptly executable. With this arrangement, a warm-up operation can be securely started immediately after the power source switch 7 is turned on depending on the user's intension.

If, on the other hand, after the complex machine 1 is started up, the user wishes to promptly bring the complex machine 1 to the electric power saving mode, the user turns the power source switch 7 on while depressing the electric power saving key 478 (Step S1). Then, the power source device 71 is operative to supply an operation power source voltage from the commercial AC power source voltage to the relevant parts in the complex machine 1 (Step S2). Then, the main controller 100 starts executing the control program stored in the ROM to check whether the electric power saving key 478 is in an on-state (Step S3).

The time duration from the point of time when the electric power switch 7 is turned on to the point of time when the main controller 100 starts executing the control program is e.g. one second or less, which is a short time, as compared with a time required for a person to manipulate the electric power switch 7 or the electric power saving key 478. Accordingly, if the user turns the electric power switch 7 on while depressing the electric power saving key 478, the electric power saving controller 106 is operative to detect that the electric power saving key 478 is in an on-state. Thereby, the routine goes to Step S6 so as to bring the complex machine 1 to the electric power saving mode.

As an operation of the electric power saving mode, for example, an electric current flowing through the heater 453 whose power consumption in a standby state is large is reduced, as compared with a condition that an electric current flows during a warm-up operation. Then, the heater 453 is heated to set the temperature of the heater roller 452 to the electric power saving temperature Ts, which is lower than the fixing temperature Tt.

As mentioned above, setting the temperature of the heater roller 452 to a temperature lower than the fixing temperature Tt is described as an example of the operation of the electric power saving mode. Alternatively, heating the heater roller 452 may be suspended, or an operation power source voltage to be supplied from the power source device 71 to the relevant parts in the complex machine 1 other than the heater 453 may be lowered, or supply of the power source voltage may be partly blocked.

By performing the above operations, if the user wishes to promptly bring the complex machine 1 to the electric power saving mode after startup of the complex machine 1, the complex machine 1 is shifted to the electric power saving mode without starting a warm-up operation in response to the user's manipulating the power source switch 7 while depressing the electric power saving key 478. With this arrangement, the complex machine 1 can be securely shifted to the electric power saving mode immediately after the power source switch 7 is turned on depending on the user's intension.

Referring back to FIG. 4, the electric power saving controller 106 is operative to check whether the electric power saving release key 479 is in an on-state (Step S7). If it is judged that the electric power saving release key 479 is in an on-state (YES in Step S7), the electric power saving controller 106 is operative to release the electric power saving mode, and the routine goes to Step S4 to perform a warm-up operation.

By performing the above operations, if the user wishes to bring the complex machine 1 to a printing ready state by releasing the electric power saving mode, the electric power saving mode can be released depending on the user's intention in response to the user's depressing the electric power saving release key 479. As mentioned above, the electric power saving key 478 for bringing the complex machine 1 to the electric power saving mode, and the electric power saving release key 479 for releasing the electric power saving mode are disposed away from each other. This eliminates or suppresses likelihood that the user may erroneously depress the electric power saving key 478 and the electric power saving release key 479, which may release the electric power saving mode or bring the complex machine 1 to the electric power saving mode against the user's intention. In this embodiment, the electric power saving key 478 and the electric power saving release key 479 are disposed away from each other.

Alternatively, the electric power saving key 478 and the electric power saving release key 479 may have different colors e.g. the electric power saving key 478 is blue, and the electric power saving release key 479 is red. The modified arrangement also eliminates or suppresses the user's erroneous operation.

Referring back to FIG. 4, if the electric power saving release key 479 is in an off state in Step S7 (NO in Step S7), the electric power saving controller 106 is operative to bring the complex machine 1 to a job waiting state waiting for a print job, in which e.g. the user is allowed to depress the start key 471, or image data transmitted from an external PC via the network is allowed to be received by the network I/F 210 (Step S8). If a print job is not accepted (NO in Step S8), the routine goes to Step S6 to cause the complex machine 1 to continue the electric power saving mode. If, on the other hand, a print job is accepted (YES in Step S8), the routine goes to Step S9 to perform a warm-up operation.

Then, the heater 453 performs a warm-up operation of heating the temperature of the heater roller 452 to the fixing temperature Tt, based on a control signal from the electric power saving controller 106 (Step S9). When the temperature of the heater roller 452 reaches the fixing temperature Tt, a printing operation is performed based on the accepted print job (Step S10).

Specifically, in Step S10, for instance, in the case where the start key 471 is depressed, and a print job of copying a document placed on the document table 52 is accepted, a series of printing operations are performed, in other words, a document image is read by the document reader 5 based on a control signal from the copier controller 104, a sheet dispensed from the sheet cassette 461 is transported to the image former 412, a toner image is transferred onto the sheet by the image former 412, based on the image read by the document reader 5, the toner image is fixed onto the sheet by the fixing device 45, and the sheet carrying the fixed toner image is discharged by the transport roller pair 464.

In Step S3, after the complex machine 1 is started up, and execution of the control program is started, the main controller 100 is promptly operative to check whether the electric power saving key 478 is in an on-state. If the electric power saving key 478 is in an off-state, it is judged that the electric power saving key 478 is in an off-state when the power source switch 7 is changed from an off-state to an on-state. If the electric power saving key 478 is in an on-state, it is judged that the electric power saving key 478 is in an on-state when the power source switch 7 is changed from an off-state to an on-state. Alternatively, the complex machine 1 may have the following configuration. Specifically, the electric power source 7 is an operation switch for outputting a control signal designating supply/non-supply of an operation power source voltage to the main controller 100 in response to a user's manipulation. The operation power source voltage is supplied to the main controller 100 even if the power source switch 7 is in an off-state. In the modified configuration, the electric power saving controller 106 performs the operation of Step S4 in the case where the power source switch 7 is in an on-state; and the electric power saving key 478 is in an off-state, and performs the operation of Step S6 in the case where the power source switch 7 is in an on-state, and the electric power saving key 478 is in an on-state.

The image forming apparatus is not limited to a complex machine, but may be an image forming apparatus other than the complex machine e.g. a copier, a printer, a facsimile machine, or a like device.

An image forming apparatus according to an aspect of the invention includes: a power source switch for turning on and off a power source of a main body of the apparatus; an electric power saving mode designation acceptor for accepting a designation to set the apparatus main body to an electric power saving mode in response to an external operation to suppress an electric power consumption of the apparatus main body; an image former for forming a toner image onto a sheet; a fixing device for thermally fixing the toner image formed on the sheet by the image former onto the sheet; a heating section for heating the fixing device; and an electric power saving controller for shifting the apparatus main body to the electric power saving mode if the electric power saving mode designation is accepted by the electric power saving mode designation acceptor, and for controlling the heating section to heat the fixing device to a predetermined fixing temperature necessary for fixing the toner image onto the sheet if the electric power saving mode designation is not accepted by the electric power saving mode designation acceptor, in response to shifting of the power source switch from an off-state to an on-state.

In the above arrangement, if the electric power saving mode designation is accepted in response to the user's manipulation of the electric power saving mode designation acceptor when the power source switch is shifted from the off-state to the on-state, the apparatus main body is shifted to the electric power saving mode. Thereby, the electric power consumption of the apparatus main body is suppressed. On the other hand, if the user does not manipulate the electric power saving mode designation acceptor, and accordingly, the electric power saving mode designation is not accepted when the power source switch is shifted from the off-state to the on-state, the heating section heats the fixing device to the predetermined fixing temperature necessary for fixing the toner image onto the sheet. Thereby, the apparatus main body is brought to a printing read state. This enables to securely set whether the electric power saving mode is to be designated, or a warm-up operation is to be started immediately after the power source of the apparatus main body is turned on depending on the user's intension.

Preferably, the heating section may heat the fixing device to a temperature lower than the fixing temperature when the apparatus main body is in the electric power saving mode.

In the above arrangement, when the apparatus main body is in the electric power saving mode, the temperature of the fixing device heated by the heating section is set to the temperature lower than the fixing temperature. This enables to suppress the electric power consumption of the heating section.

Preferably, the image forming apparatus may further include an electric power saving release acceptor for accepting a designation to release the electric power saving mode in response to an external operation, wherein the electric power saving mode designation acceptor and the electric power saving release acceptor are disposed away from each other by a distance corresponding to at least a width of a finger of a human or more.

In the above arrangement, the electric power saving mode designation acceptor and the electric power saving release acceptor are disposed away from each other by the distance corresponding to at least the width of a finger of a human or more. This enables to reduce likelihood that the user may erroneously operate the electric power saving mode designation acceptor and the electric power saving release acceptor.

Preferably, the electric power saving mode designation acceptor and the electric power saving release acceptor may be disposed away from each other by 2 cm or more.

In the above arrangement, the electric power saving mode designation acceptor and the electric power saving release acceptor are disposed away from each other by the distance substantially equal to the width of a finger of a human or more. This enables to reduce likelihood that the user may erroneously operate the electric power saving mode designation acceptor and the electric power saving release acceptor.

Preferably, the electric power saving mode designation acceptor may be a substantially circular-shaped press button switch, and the electric power saving mode designation acceptor and the electric power saving release acceptor may be disposed away from each other by a distance equal to seven times as large as the diameter of the electric power saving mode designation acceptor or more.

In the above arrangement, since the arranged position of the electric power saving mode designation acceptor and the arranged position of the electric power saving release acceptor are obviously different, there is no or less likelihood that the user may erroneously operate the electric power saving mode designation acceptor and the electric power saving release acceptor.

Preferably, the image forming apparatus may further include an electric power saving release acceptor for accepting a designation to release the electric power saving mode in response to an external operation, wherein the electric power saving mode designation acceptor and the electric power saving release acceptor have different colors from each other.

In the above arrangement, the electric power saving mode designation acceptor and the electric power saving release acceptor have the different colors from each other. This enables to reduce likelihood that the user may erroneously operate the electric power saving mode designation acceptor and the electric power saving release acceptor.

Preferably, the electric power saving mode designation acceptor may be blue, and the electric power saving release acceptor may be red, or vice versa.

Blue and red have high visibility and easily recognizable. Accordingly, the above arrangement enables to reduce likelihood that the user may erroneously operate the electric power saving mode designation acceptor and the electric power saving release acceptor.

Preferably, the electric power saving mode designation acceptor may be a press button switch which is operated to accept the electric power saving mode designation exclusively when the electric power saving mode designation acceptor is depressed.

In the above arrangement, by shifting the power source switch from the off-state to the on-state while depressing the press button switch as the electric power saving mode designation acceptor, the apparatus main body can be shifted to the electric power saving mode. This facilitates the operation of shifting the apparatus main body to the electric power saving mode.

This application is based on Japanese Patent Application No. 2006-241896 filed on Sep. 6, 2006, the contents of which are hereby incorporated by reference.

Although the invention has been appropriately and fully described by way of examples with reference to the accompanying drawings, it is to be understood that various changes and/or modifications will be apparent to those skilled in the art. Therefore, unless otherwise such changes and/or modifications depart from the scope of the present invention hereinafter defined, they should be construed as being included therein.

What is claimed is:

1. An image forming apparatus, comprising:

a power source switch for turning on and off a power source of a main body of the apparatus;

an electric power saving key for accepting a designation to set the apparatus main body to an electric power saving mode in response to depressing the electric power saving key to suppress an electric power consumption of the apparatus main body;

an image former for forming a toner image on a sheet;

a fixing device for thermally fixing the toner image formed on the sheet by the image former onto the sheet;

a heating section for heating the fixing device; and an electric power saving controller for shifting the apparatus main body to the electric power saving mode without starting a warm-up operation for controlling the heating section to heat the fixing device to a predetermined fixing temperature necessary for fixing the toner image onto the sheet, if the power source switch is turned on while depressing the electric power saving key, and for controlling the heating section to execute the warm-up operation and heat the fixing device to the predetermined fixing temperature without shifting the apparatus main body to the electric power saving mode, if the power source switch is turned on without depressing the electric power saving key.

2. The image forming apparatus according to claim 1, wherein the heating section heats the fixing device to a temperature lower than the fixing temperature when the apparatus main body is in the electric power saving mode.

3. The image forming apparatus according to claim 1, further comprising an electric power saving release acceptor for accepting a designation to release the electric power saving mode in response to an external operation, wherein the electric power saving key and the electric power saving release acceptor are disposed away from each other by a distance corresponding to at least a width of a finger of a human or more.

4. The image forming apparatus according to claim 3, wherein the electric power saving mode designation acceptor and the electric power saving release acceptor are disposed away from each other by 2 cm or more.

5. The image forming apparatus according to claim 3, wherein the electric power saving key is a substantially circular-shaped press button switch, and the electric power saving mode designation acceptor and the electric power saving release acceptor are disposed away from each other by a distance equal to seven times as large as the diameter of the electric power saving mode designation acceptor or more.

6. The image forming apparatus according to claim 1, further comprising an electric power saving release acceptor for accepting a designation to release the electric power saving mode in response to an external operation, wherein the electric power saving key and the electric power saving release acceptor have different colors from each other.

7. The image forming apparatus according to claim 6, wherein the electric power saving key is blue, and the electric power saving release acceptor is red, or vice versa.

8. The image forming apparatus according to claim 1, wherein the electric power saving key is a press button switch which is operated to accept the electric power saving mode designation exclusively when the electric power saving key is depressed.

* * * * *